US012168590B2

(12) United States Patent
Thenemann et al.

(10) Patent No.: US 12,168,590 B2
(45) Date of Patent: Dec. 17, 2024

(54) MOTORIZED RETRACTABLE RIBBON BARRIER

(71) Applicant: Banner Stakes, LLC, Dublin, CA (US)

(72) Inventors: Jennifer Thenemann, Danville, CA (US); Gregory Snyder, Novato, CA (US)

(73) Assignee: Banner Stakes, LLC, Dublin, CA (US)

( * ) Notice: Subject to any disclaimer, the term of this patent is extended or adjusted under 35 U.S.C. 154(b) by 509 days.

(21) Appl. No.: 17/517,002

(22) Filed: Nov. 2, 2021

(65) Prior Publication Data

US 2022/0135366 A1 May 5, 2022

Related U.S. Application Data

(60) Provisional application No. 63/109,124, filed on Nov. 3, 2020.

(51) Int. Cl.
*B65H 75/44* (2006.01)
*B65H 75/48* (2006.01)
*E01F 13/02* (2006.01)

(52) U.S. Cl.
CPC ..... *B65H 75/4471* (2013.01); *B65H 75/4428* (2013.01); *B65H 75/4486* (2013.01); *B65H 75/48* (2013.01); *E01F 13/028* (2013.01)

(58) Field of Classification Search
CPC ..... B65H 75/38; B65H 75/4428; B65H 75/4431; B65H 75/4442; B65H 75/4471; B65H 75/4481; B65H 75/4486; B65H 75/48; B65H 75/486; B65H 2701/374; E01F 13/022; E01F 13/024; E01F 13/028
See application file for complete search history.

(56) References Cited

U.S. PATENT DOCUMENTS 4,764,998 A 8/1988 Norris et al.
4,844,420 A * 7/1989 Oster ..... B65H 75/48 49/34
7,690,858 B1 * 4/2010 Chiavola ..... E01F 13/028 340/908
8,118,250 B1 * 2/2012 Helseth ..... B65H 75/425 242/396.5
8,500,360 B1 * 8/2013 Jones ..... E01F 9/70 404/9
9,947,250 B2 * 4/2018 Yang ..... G09F 27/005
(Continued)

FOREIGN PATENT DOCUMENTS

WO WO-02092916 A1 * 11/2002 ..... B65H 75/38
WO WO-2013059895 A1 * 5/2013 ..... E01F 13/028
(Continued)

*Primary Examiner* — Michael R Mansen
*Assistant Examiner* — Raveen J Dias
(74) *Attorney, Agent, or Firm* — Occhiuti & Rohlicek LLP

(57) ABSTRACT

An apparatus includes a housing, a rotatable spool disposed within the housing, a belt at least partially wound onto the spool, a motorized retraction mechanism disposed within the housing, coupled to the spool, and configured cause rotation of the spool in a first direction for winding the belt onto the spool, and a tensioning mechanism disposed within the housing, coupled to the spool, and configured to prevent over-rotation of the spool in a second direction opposite the first direction while the belt is being dispensed from the spool.

9 Claims, 8 Drawing Sheets

(56) References Cited

U.S. PATENT DOCUMENTS

2002/0063248 A1* 5/2002 Siegler ..... E01F 13/028 256/37
2004/0144966 A1* 7/2004 Tsai ..... E01F 13/028 256/45
2005/0023403 A1* 2/2005 Lu ..... B65H 75/4447 242/381.5
2005/0098770 A1* 5/2005 Schell ..... E01F 13/028 256/25
2005/0168818 A1 8/2005 Hudson
2005/0191107 A1* 9/2005 Christie ..... E01F 13/028 400/208
2005/0220537 A1 10/2005 Bentley
2007/0176158 A1* 8/2007 Robinson ..... E01F 13/028 256/12.5
2007/0193705 A1* 8/2007 Hsu ..... E04H 12/2215 160/238
2009/0008042 A1* 1/2009 Snyder ..... E01F 13/028 160/264
2010/0044661 A1* 2/2010 Weiner ..... E04H 12/2215 256/1
2010/0314480 A1* 12/2010 Gallacher ..... E01F 13/028 242/379
2011/0120823 A1* 5/2011 Hansen ..... E01F 13/028 404/13
2012/0256149 A1* 10/2012 Sylvester ..... E01F 13/028 256/73
2013/0306926 A1* 11/2013 Bock ..... E01F 13/028 256/1
2014/0014760 A1* 1/2014 Tsai ..... E01F 13/028 242/396
2014/0077021 A1* 3/2014 Beemsterboer ..... B65H 75/446 15/256.5
2015/0218848 A1 8/2015 Weiner
2017/0032720 A1 2/2017 Yang et al.
2017/0167093 A1* 6/2017 Punzengruber ..... E01F 13/022
2018/0170709 A1* 6/2018 Chen ..... E01F 13/028
2018/0273341 A1* 9/2018 Vitas ..... B65H 75/486
2018/0334354 A1* 11/2018 Orsini ..... G01B 3/1041
2019/0011081 A1* 1/2019 Kalinski ..... A47G 5/02
2020/0302833 A1* 9/2020 Kay ..... G09F 9/301
2022/0136187 A1* 5/2022 Thenemann ..... E04H 17/131
2022/0259889 A1* 8/2022 Jordan ..... E04H 17/266

FOREIGN PATENT DOCUMENTS

WO WO-2014015411 A1 * 1/2014 ..... B65H 75/38
WO WO-2019174024 A1 * 9/2019 ..... B65H 75/48

* cited by examiner

MOTORIZED RETRACTABLE RIBBON BARRIER

CROSS REFERENCE TO RELATED APPLICATIONS

This application claims priority to provisional Application 63/109,124 filed Nov. 3, 2020, the contents of which are hereby incorporated by reference.

BACKGROUND OF THE INVENTION

This application relates to devices for urging people to form queues, and in particular, to arrays of stanchions interconnected by belts, straps, ribbons, or webbing.

A stanchion is an upright bar or post that includes retractable belts, velvet ropes, or plastic chains, sometimes in conjunction with wall-mounted barrier devices, barricades, and printed signage and often used for crowd control and engineering people flow and construction site safety. Such stanchions can be found, for example, at banks, stores, hotels, museums, concert venues, trade shows. Stanchions can also be found around construction work sites where hazardous areas need to be clearly marked.

SUMMARY OF THE INVENTION

In a general aspect, an apparatus includes a housing, a rotatable spool disposed within the housing, a belt at least partially wound onto the spool, a motorized retraction mechanism disposed within the housing, coupled to the spool, and configured cause rotation of the spool in a first direction for winding the belt onto the spool, and a tensioning mechanism disposed within the housing, coupled to the spool, and configured to prevent over-rotation of the spool in a second direction opposite the first direction while the belt is being dispensed from the spool.

Aspects may include one or more of the following features.

The apparatus may include an attachment mechanism disposed in the housing, the attachment mechanism configured to secure the apparatus on a stanchion. The attachment mechanism may be configured to receive portion of the stanchion and engage with the portion of the stanchion to secure the apparatus on the stanchion. The attachment mechanism, au be releasable for removal of the apparatus from the stanchion.

The Apparatus may include one or more resilient members protruding from an outer surface of the housing. The apparatus may include one or more attachment members configured for attaching the apparatus to an element in an environment. The one or more attachment members may be configured for hanging the apparatus from the element in the environment. The one or more attachment members may include one or more loops configured to receive a strap for attaching the apparatus the element in the environment.

The apparatus may include a rotatable dispensing nozzle disposed on an opening in the housing, wherein the belt passes through the rotatable dispensing nozzle as it is wound on or dispensed from the spool. The rotatable dispensing nozzle may be rotatable between a first position and a second position, an orientation of the belt in the first position being orthogonal to an orientation of the belt in the second position.

Other features and advantages of the invention are apparent from the following description, and from the claims.

DETAILED DESCRIPTION

1 Overview

Figure 1:
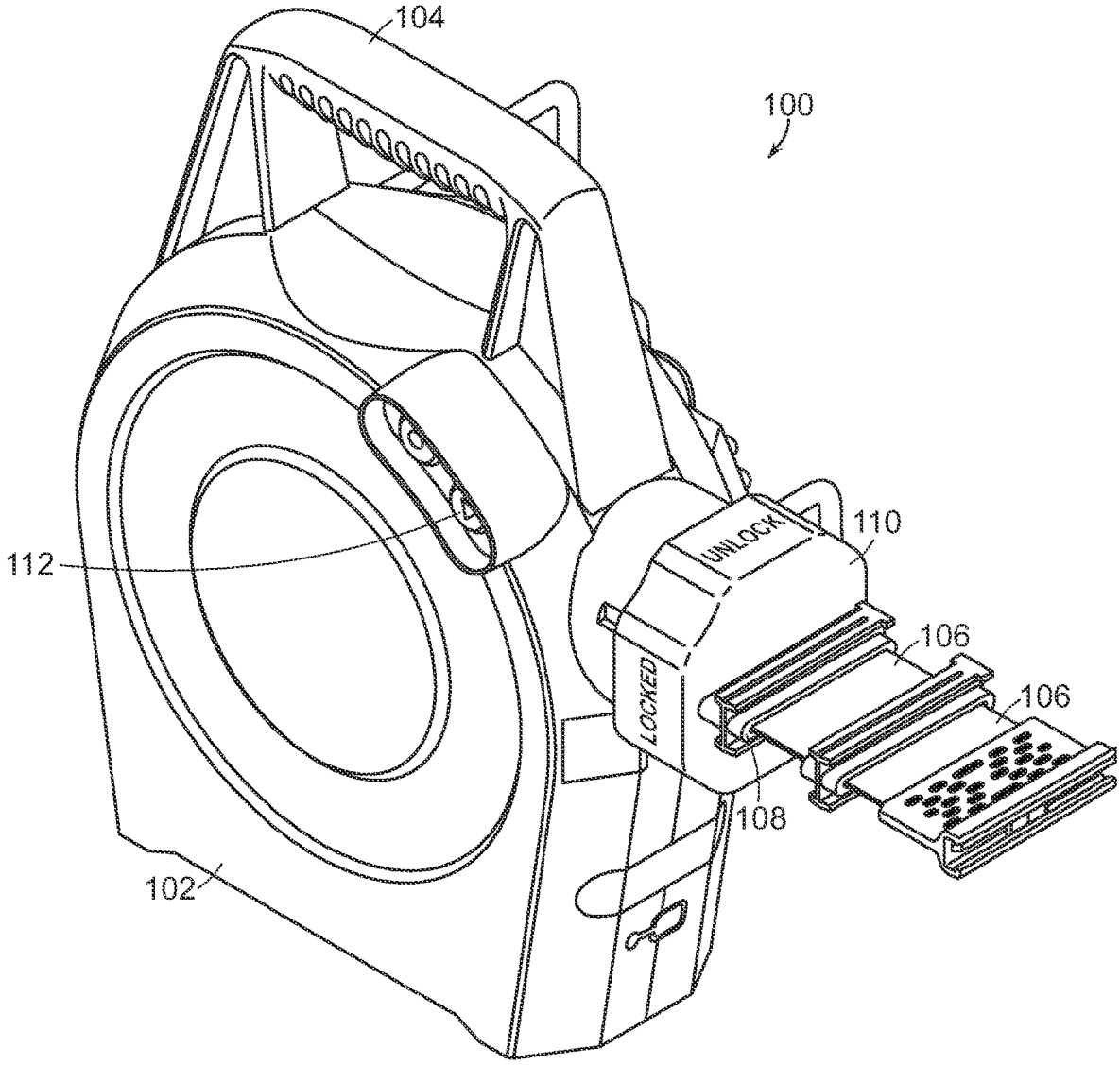
FIG. 1 is a handheld barrier.
Figure 2:
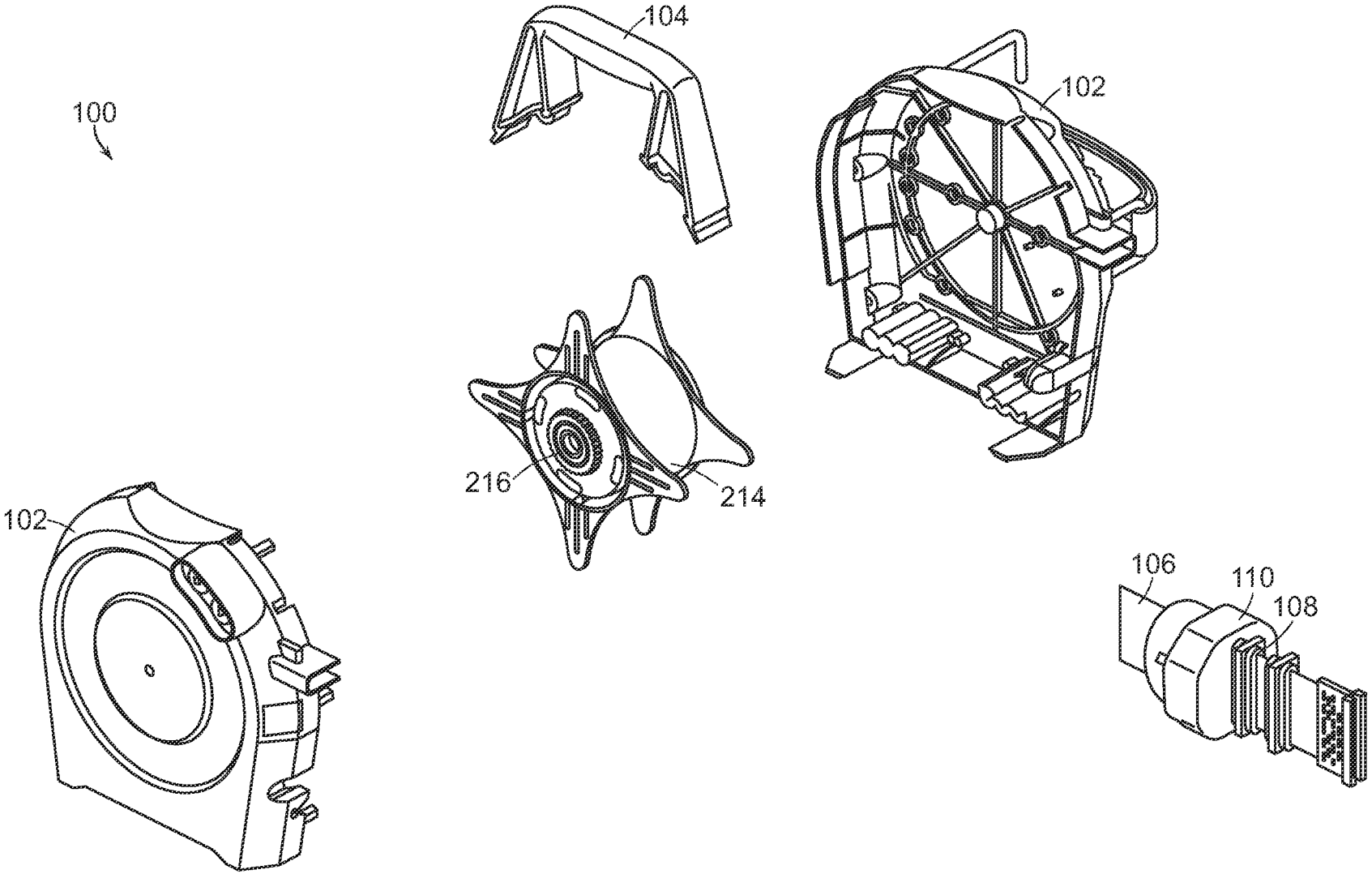
FIG. 2 is an exploded view of the handheld barrier of FIG. 1.

Referring to FIGS. 1 and 2, a handheld, retractable ribbon barrier 100 includes a housing 102 with a handle 104 attached thereto. A ribbon barrier 106 (sometimes referred to as a belt) is dispensed from an opening 108 in a rotatable dispensing nozzle 110.

Very generally, and is described in greater detail below, the ribbon barrier 106 is wound onto a spool 214 inside of the housing 102. A user of the barrier 100 withdraws the ribbon barrier 106 through the opening 108 in the rotating dispensing nozzle 110 by manually pulling on the ribbon barrier 106. Withdrawal of the ribbon barrier 106 causes the ribbon barrier 106 to unwind from the spool 214. The user can then retract the ribbon barrier 106 by pressing a retraction button 112 to activate a motorized retraction mechanism 216 disposed within the spool 214 (described in greater detail below), which winds the ribbon barrier 106 back onto the spool 214.

Figure 3:
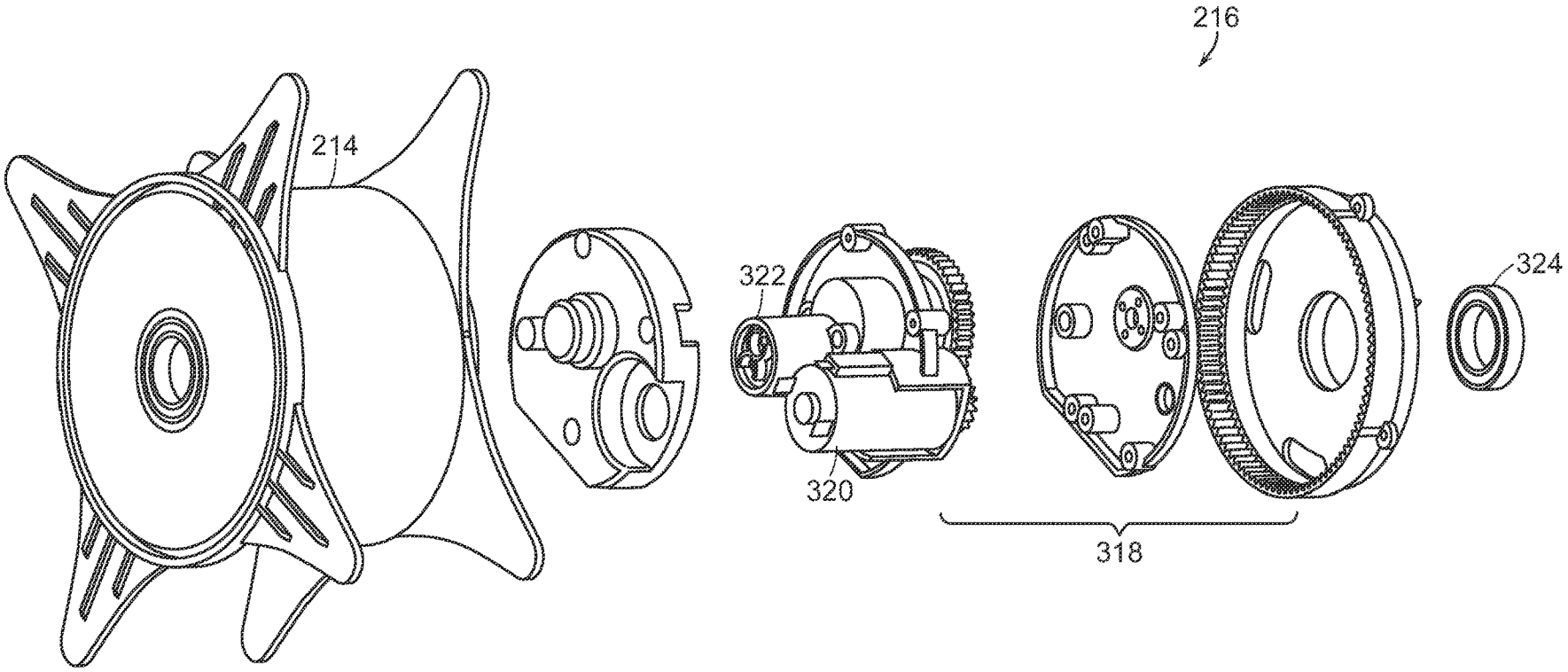
FIG. 3 is a first exploded view of a motorized retraction mechanism.
Figure 4:
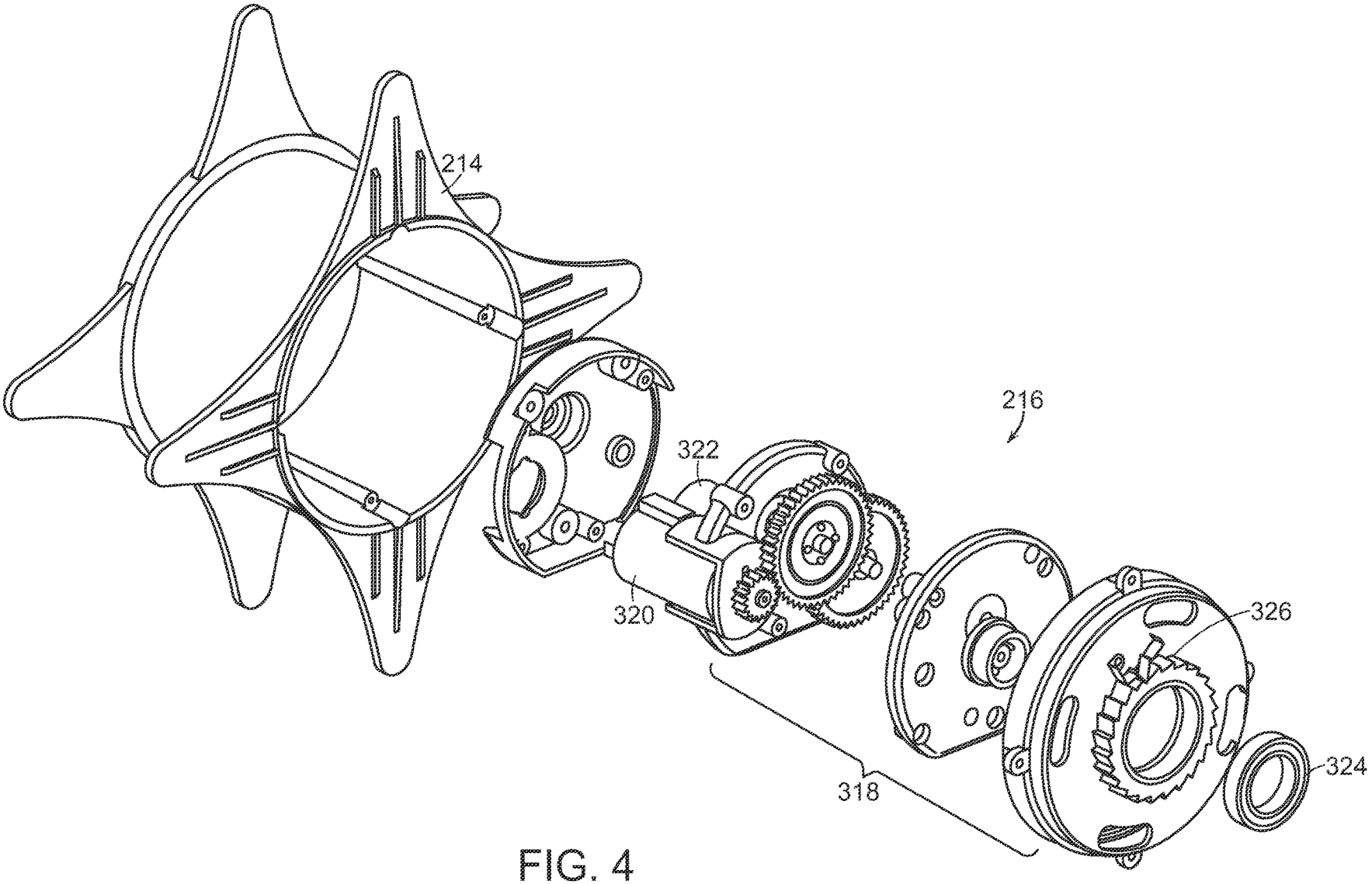
FIG. 4 is a second exploded view of a motorized retraction mechanism.

Referring to FIGS. 3 and 4, the motorized retraction mechanism 216 is rigidly coupled to the spool 214 (e.g., by fasteners such as screws) such that the spool 214 and the motorized retraction mechanism 216 are rotatable within the housing 102.

The motorized retraction mechanism includes a gear mechanism 318 coupled to a motor 320 and a spring 322 (e.g., a constant force or power spring). Very generally, when the user presses the retraction button 112, power is supplied to the motor 320 (e.g., from a battery, not shown), causing the motor 320 to rotate gears of the gear mechanism 318 in a first direction. Rotation of the gears of the gear mechanism 318 in the first direction causes rotation of the spool 214 relative to the housing 102 such that the ribbon barrier 106 is retracted and wound onto the spool 214.

To dispense the ribbon barrier 106 from the spool 214, a user pulls on the ribbon barrier 106 and this manual action causes to spool 214 to rotate in a direction relative to the housing 102 such that the ribbon barrier 106 unwinds from the spool 214. The gears of the gear mechanism 216 may or may not be engaged or rotate as the ribbon barrier 106 is dispensed from the spool 214.

Conventionally, when the user stops pulling on the ribbon barrier 106, the spool 214 may have considerable momentum such that it continues to rotate and dispense ribbon barrier 106 from the spool 214 while the user is no longer pulling the ribbon barrier 106 out of the housing 102 through the dispensing nozzle 110. This can result in the ribbon barrier 106 being dispensed into the housing 102 and bunching up or becoming tangled.

The spring 322 (sometimes referred to as a tensioning mechanism) is configured maintain tension on the ribbon barrier 106 (e.g., via the gear mechanism 318) to prevent the bunching or tangling scenario described above.

In some examples, the motorized retraction mechanism 216 includes a bearing 324 to reduce friction as the spool 214 rotates.

In some examples, the motorized retraction mechanism 216 includes a releasable ratchet mechanism 326 that is configured engage and lock the motorized retraction mechanism 216 with a desired amount of ribbon barrier 106 dispensed. The ratchet mechanism 326 can be disengaged (e.g., by pressing a button, not shown) to allow the motorized retraction mechanism 216 to rotate freely.

Figure 5:
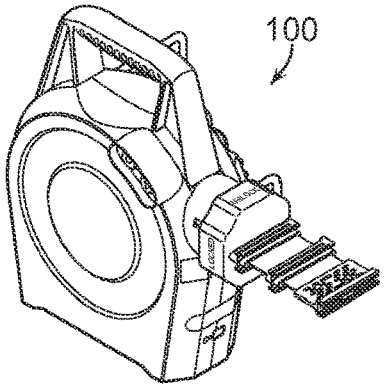
FIG. 5 shows the handheld barrier of FIG. 1 being secured to a post.
Figure 5:
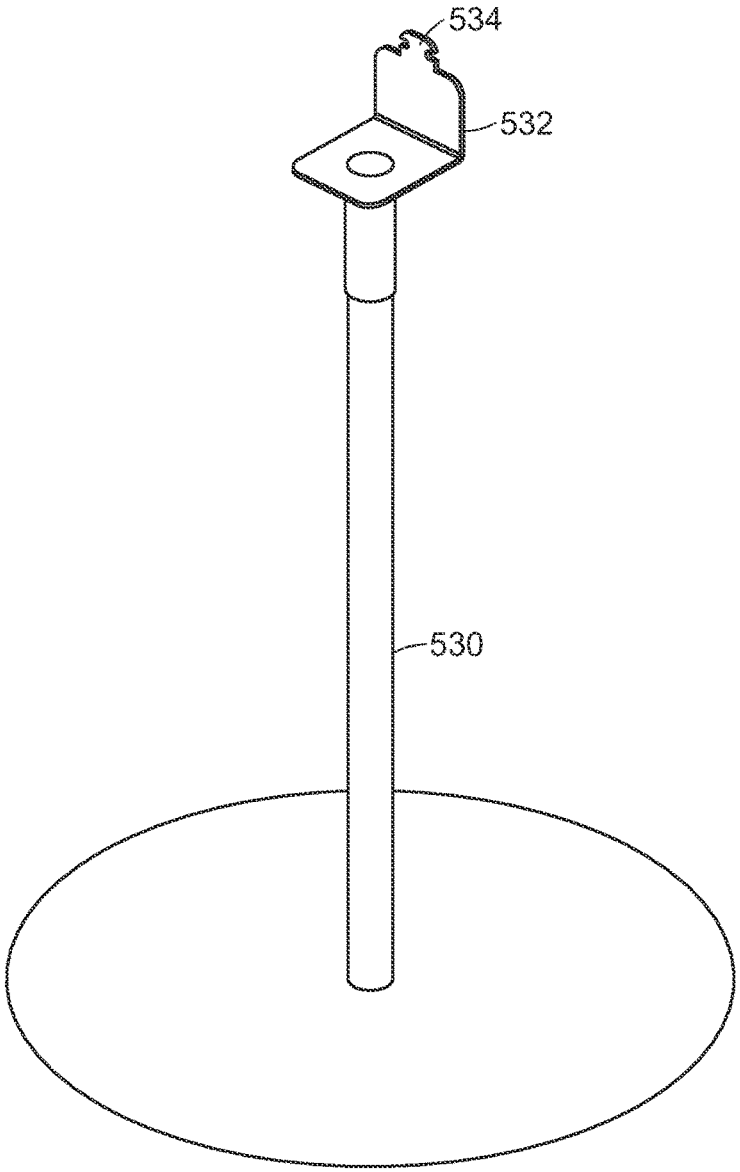
Figure 6:
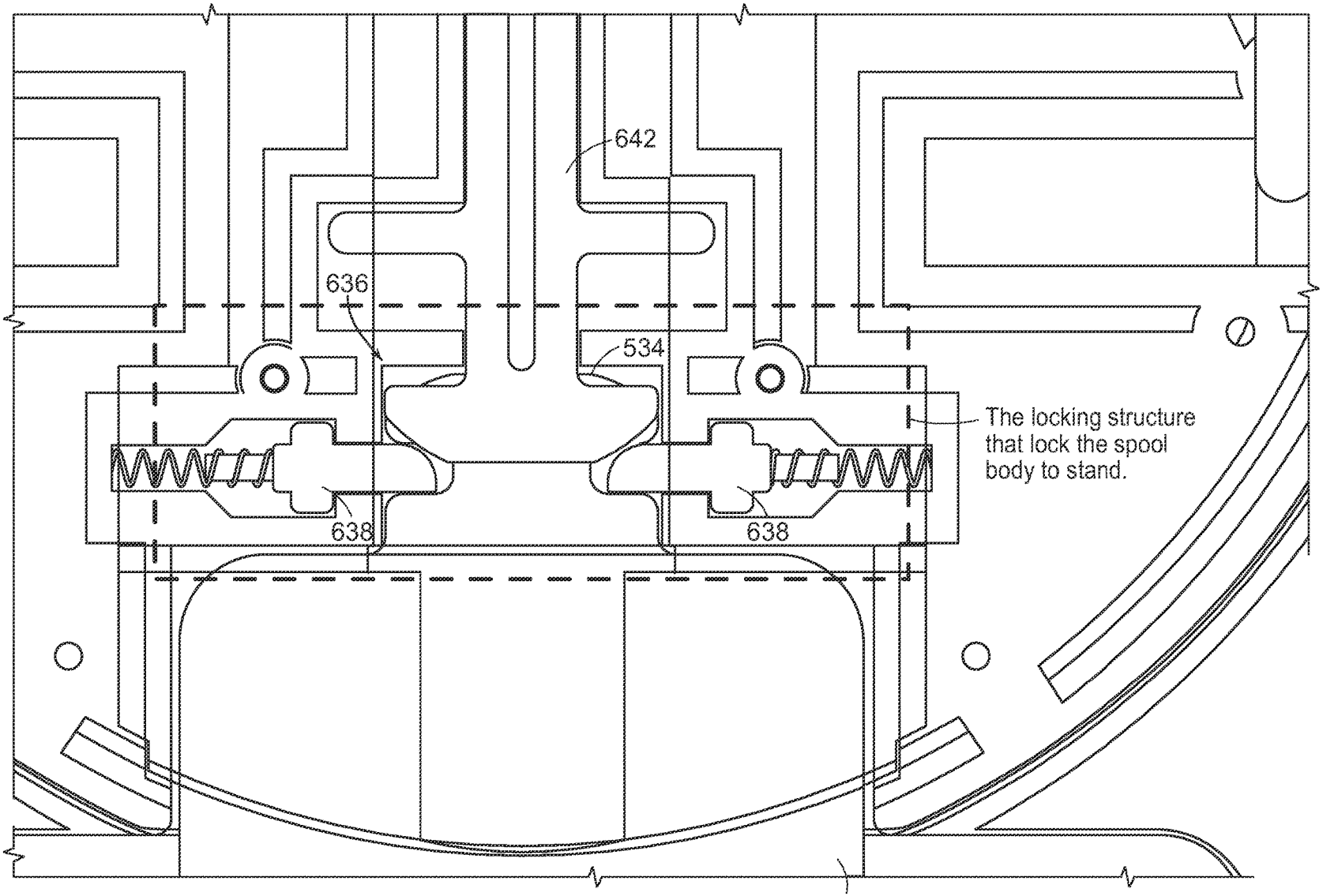
FIG. 6 shows how the handheld barrier of FIG. 1 is secured to the post of FIG. 5.

Referring to FIGS. 5 and 6, in some examples, the barrier 100 is configured to be secured to a post or stanchion 530 via an attachment head 532 affixed to the post or stanchion 530. The attachment head 532 includes a catch 534 that is configured for insertion into a receptacle 636 within the housing 102. Spring loaded teeth 638 within the receptacle 636 engage the catch 534 to secure the catch 534 within the receptacle 636. In some examples, the catch 534 is released from the receptacle 636 by disengaging the spring-loaded teeth 638 from the catch 534 by pressing a release button (see FIG. 8, element 840) coupled to a plunger 642.

Figure 7:
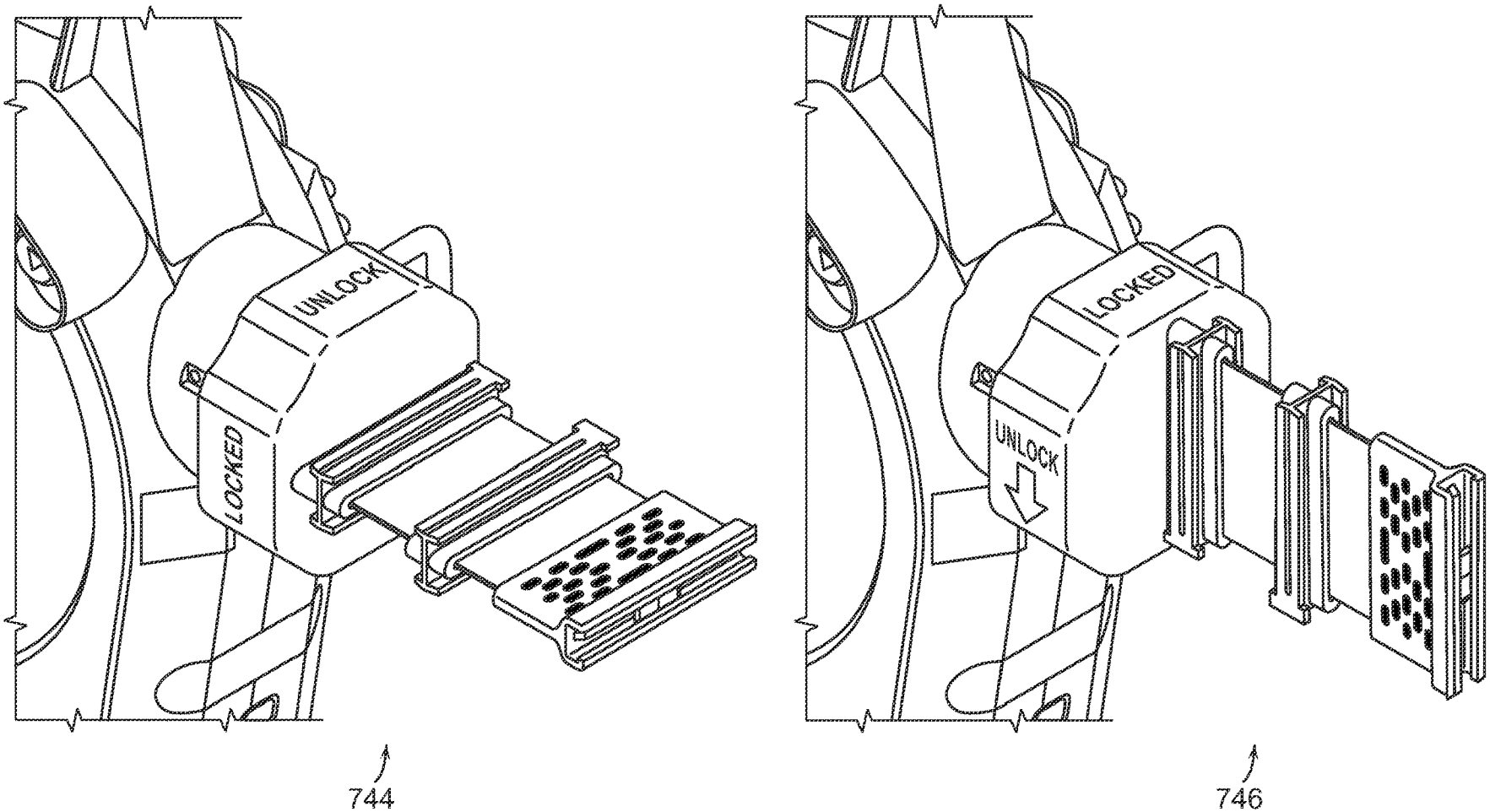
FIG. 7 shows as dispensing nozzle rotated between two positions.

Referring to FIG. 7, in some examples, the rotating dispensing nozzle 110 is rotatable between two positions, an unlocked position 744 and a locked position 746. The orientation of the dispensed ribbon barrier 106 along its length in the locked position 746 is orthogonal the orientation of the dispensed ribbon barrier 106 along its length in the unlocked position 744. In some examples, the ribbon barrier 106 is prevented from being further dispensed when the nozzle 110 is in the locked position 746 (e.g., by locking the ratcheting mechanism 326).

Figure 8:
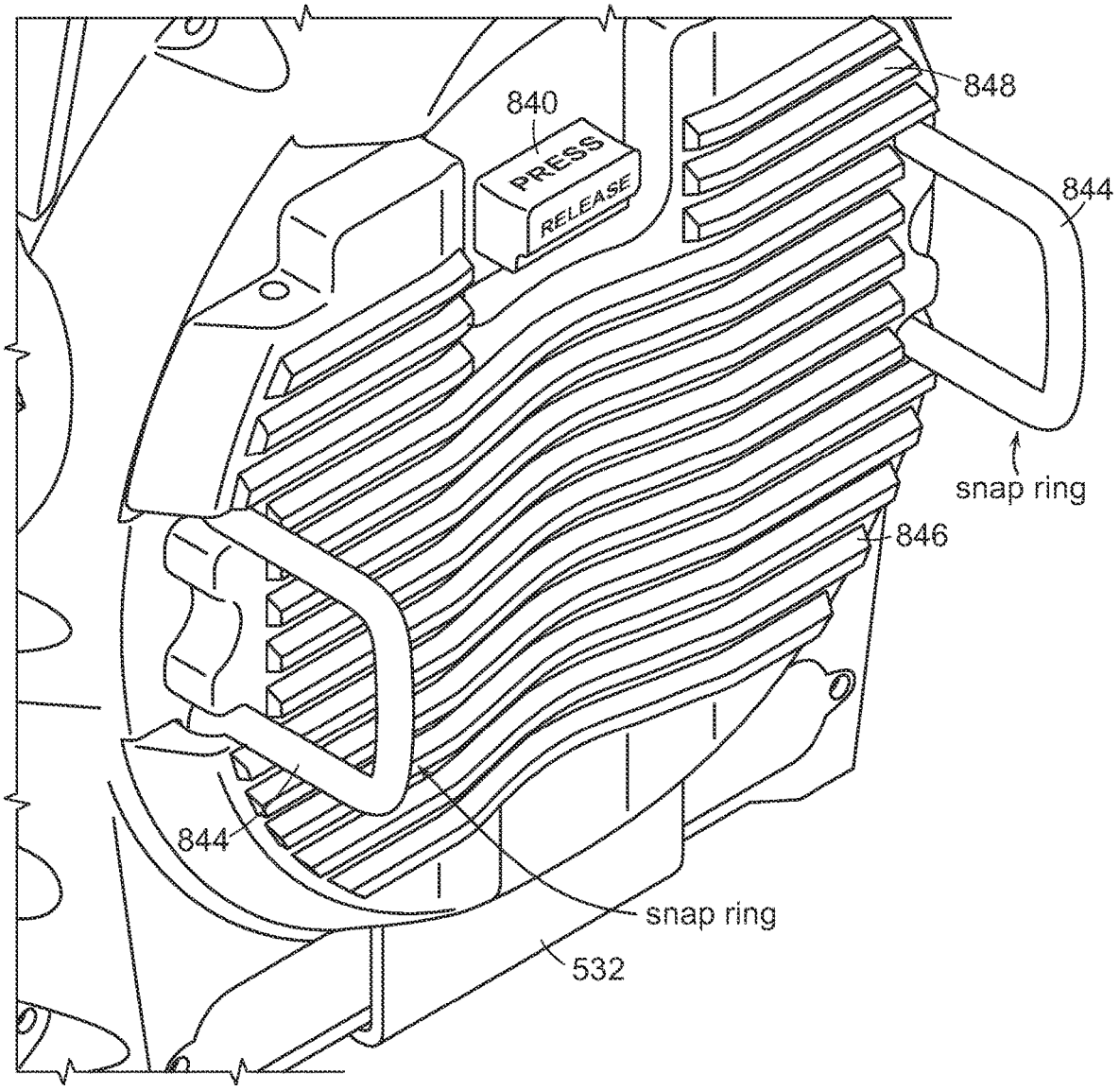
FIG. 8 shows a side view of the handheld barrier of FIG. 1.

Referring to FIG. 8, in some examples, the barrier 100 is configured to be secured to elements in the environment (e.g., trees, signposts, fence posts, etc.). For example, attachment rings 844 are configured to receive a strap (not shown) for securing the barrier 100 to an element in the environment. In some examples, the rings 844 are foldable/stowable for protection when not being used.

In other examples, stowable hooks (not shown) may be included in the housing 102 of the barrier 100 such that the barrier 100 can be hung from elements in the environment (e.g., a railing).

In some examples, a surface 846 of the barrier 100 includes rubberized overmold members 848 disposed thereon for contacting elements in the environment to protect the housing 102 of the barrier 100 and to provide additional friction between the barrier 100 and elements in the environment to which the barrier 100 is attached.

In some examples, the barrier 100 includes an integrated safety light and/or flashlight feature (not shown).

In some examples, the ribbon barrier 106 includes a latching member disposed at its end and a sliding member disposed along its length as is described in greater detail in U.S. Pat. No. 9,890,506, the contents of which are incorporated herein by reference.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. An apparatus comprising:

a housing;

a rotatable spool disposed within the housing;

a belt at least partially wound onto the spool;

a motorized retraction mechanism disposed within the housing, coupled to the spool, and configured to cause rotation of the spool in a first direction for winding the belt onto the spool;

a tensioning mechanism disposed within the housing, coupled to the spool, and configured to prevent over-rotation of the spool in a second direction opposite the first direction while the belt is being dispensed from the spool; and a rotatable dispensing nozzle disposed on an opening in the housing, wherein the belt passes through the rotatable dispensing nozzle as it is wound on or dispensed from the spool.

2. The apparatus of claim 1, further comprising an attachment mechanism disposed in the housing, the attachment mechanism configured to secure the apparatus on a stanchion.

3. The apparatus of claim 2 wherein the attachment mechanism is configured to receive a portion of the stanchion and engage with the portion of the stanchion to secure the apparatus on the stanchion.

4. The apparatus of claim 2 wherein the attachment mechanism is releasable for removal of the apparatus from the stanchion.

5. The apparatus of claim 1 further comprising one or more resilient members protruding from an outer surface of the housing.

6. The apparatus of claim 1 further comprising one or more attachment members configured for attaching the apparatus to an element in an environment.

7. The apparatus of claim 6 wherein the one or more attachment members are configured for hanging the apparatus from the element in the environment.

8. The apparatus of claim 6 wherein the one or more attachment members include one or more loops configured to receive a strap for attaching the apparatus to the element in the environment.

9. The apparatus of claim 1 wherein the rotatable dispensing nozzle is rotatable between a first position and a second position, an orientation of the belt in the first position being orthogonal to an orientation of the belt in the second position.

* * * * *